US006701574B2

(12) United States Patent
Hashim et al.

(10) Patent No.: US 6,701,574 B2
(45) Date of Patent: Mar. 9, 2004

(54) DECKLID HINGE FOR VEHICLE

(75) Inventors: Waqar Hashim, Grand Blanc, MI (US); Akin O Ajilore, Macomb, MI (US); Glenn J Esch, St. Johns, MI (US); Carl E Chamberlain, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/153,054

(22) Filed: May 21, 2002

(65) Prior Publication Data

US 2003/0217436 A1 Nov. 27, 2003

(51) Int. Cl.[7] ..... E05F 1/08
(52) U.S. Cl. ..... 16/289; 16/288; 16/370
(58) Field of Search ..... 16/289–292, 366, 16/370, 286, 288; 49/386; 296/76; 180/69.2, 69.21, 274

(56) References Cited

U.S. PATENT DOCUMENTS

| | | | | | |
|---|---|---|---|---|---|
| 1,496,965 | A | * | 6/1924 | Aldeen | 217/60 G |
| 2,091,673 | A | * | 8/1937 | De Orion | 180/69.2 |
| 2,520,921 | A | * | 9/1950 | Foster | 16/401 |
| 2,645,810 | A | * | 7/1953 | Galla | 16/288 |
| 2,840,847 | A | * | 7/1958 | Danser | 16/288 |
| 2,956,303 | A | * | 10/1960 | Fielder | 16/288 |
| 3,351,975 | A | * | 11/1967 | Goto | 16/288 |
| 3,747,271 | A | * | 7/1973 | Adamski | 49/340 |
| 3,815,176 | A | * | 6/1974 | Porter | 16/288 |
| 4,679,841 | A | * | 7/1987 | Taunay | 296/76 |
| 4,947,516 | A | * | 8/1990 | Kretchman et al. | 16/289 |
| 6,397,434 | B1 | * | 6/2002 | Cheal et al. | 16/370 |
| 6,499,189 | B2 | * | 12/2002 | Kondo et al. | 16/289 |

FOREIGN PATENT DOCUMENTS

EP 03006690 A1 * 1/1989

* cited by examiner

*Primary Examiner*—Chuck Y. Mah
(74) *Attorney, Agent, or Firm*—Laura C. Hargitt

(57) ABSTRACT

A decklid hinge is provided for a rear compartment of a vehicle. The decklid hinge includes a body side strap adapted to be connected to a vehicle body of the vehicle. The decklid hinge also includes a decklid side strap adapted to be connected to a decklid for closing a recess of the rear compartment. The decklid hinge includes a first link interconnecting the body side strap and the decklid strap for allowing rotation therebetween. The decklid hinge also includes a second link interconnecting the body side strap and the decklid strap for guiding pivoting action of the hinge along a predefined path. The decklid hinge further includes a counterbalance spring interconnecting the body side strap and the decklid strap to counterbalance a weight of the decklid in an open position.

15 Claims, 3 Drawing Sheets

DECKLID HINGE FOR VEHICLE

TECHNICAL FIELD

The present invention relates generally to hinges for vehicles and, more particularly, to a decklid hinge for a vehicle.

BACKGROUND OF THE INVENTION

It is known to provide a decklid for a vehicle to open and close a rear compartment of a vehicle body of the vehicle. Typically, the deck lid is attached to the vehicle body with at least one, preferably a pair of laterally spaced hinges. Currently, the decklid hinges do not allow springs to be used as a counterbalance mechanism due to the use of spring pre-tensioners and instead include a gas strut for counterbalancing the weight of the decklid. However, gas struts are expensive, and provide varying force with change in temperatures. Further, to install a backlite glass, the decklid needs to be removed and reinstalled to the vehicle body to provide access for glass load and install. This requires another set of fixtures and creates the possibility of paint damage. There is also added labor associated with refitting the decklid after the glass is installed.

Therefore, it is desirable to provide a decklid hinge for a vehicle that includes a counterbalance spring to counter the weight of the decklid. It is also desirable to provide a decklid hinge for a vehicle that eliminates the need for removing and reinstalling the decklid. Therefore, there is a need in the art to provide a decklid hinge for a vehicle that meets these desires.

SUMMARY OF THE INVENTION

It is, therefore, one object of the present invention to provide a new decklid hinge for a vehicle.

It is another object of the present invention to provide a decklid hinge for a vehicle that includes a counterbalance spring.

To achieve the foregoing objects, the present invention is a decklid hinge for a decklid on a rear compartment of a vehicle including a body side strap adapted to be connected to a vehicle body of the vehicle. The decklid hinge also includes a decklid side strap adapted to be connected to a decklid for closing a recess of the rear compartment. The decklid hinge includes a first link interconnecting the body side strap and the decklid strap for allowing rotation therebetween. The decklid hinge also includes a second link interconnecting the body side strap and the decklid strap for guiding pivoting action of the hinge along a predefined path. The decklid hinge further includes a counterbalance spring interconnecting the body side strap and the decklid strap to counterbalance a weight of the decklid in an open position.

One advantage of the present invention is that a decklid hinge having a counterbalance spring is provided for a decklid of a vehicle. Another advantage of the present invention is that the decklid hinge eliminates the need for using a more expensive gas strut as a counterbalance by allowing installation of the counterbalance spring. Yet another advantage of the present invention is that the decklid hinge has a service position that eliminates the need for a spring pre-tensioner tool. Still another advantage of the present invention is that the decklid hinge has a service position that eliminates the need for removing and reinstalling the decklid in general assembly for loading and installing a rear backlite glass. A further advantage of the present invention is that the decklid hinge eliminates a closeout or glass molding/seal at the bottom edge of the backlite or decklid to glass interface by creating room to tuck the bottom edge of the glass under the leading edge of the decklid. As a result, the decklid does not require retrofitting to meet the gap and flushness specifications after glass install. Yet a further advantage of the present invention is that the decklid hinge eliminates decklid refit fixtures for general assembly.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
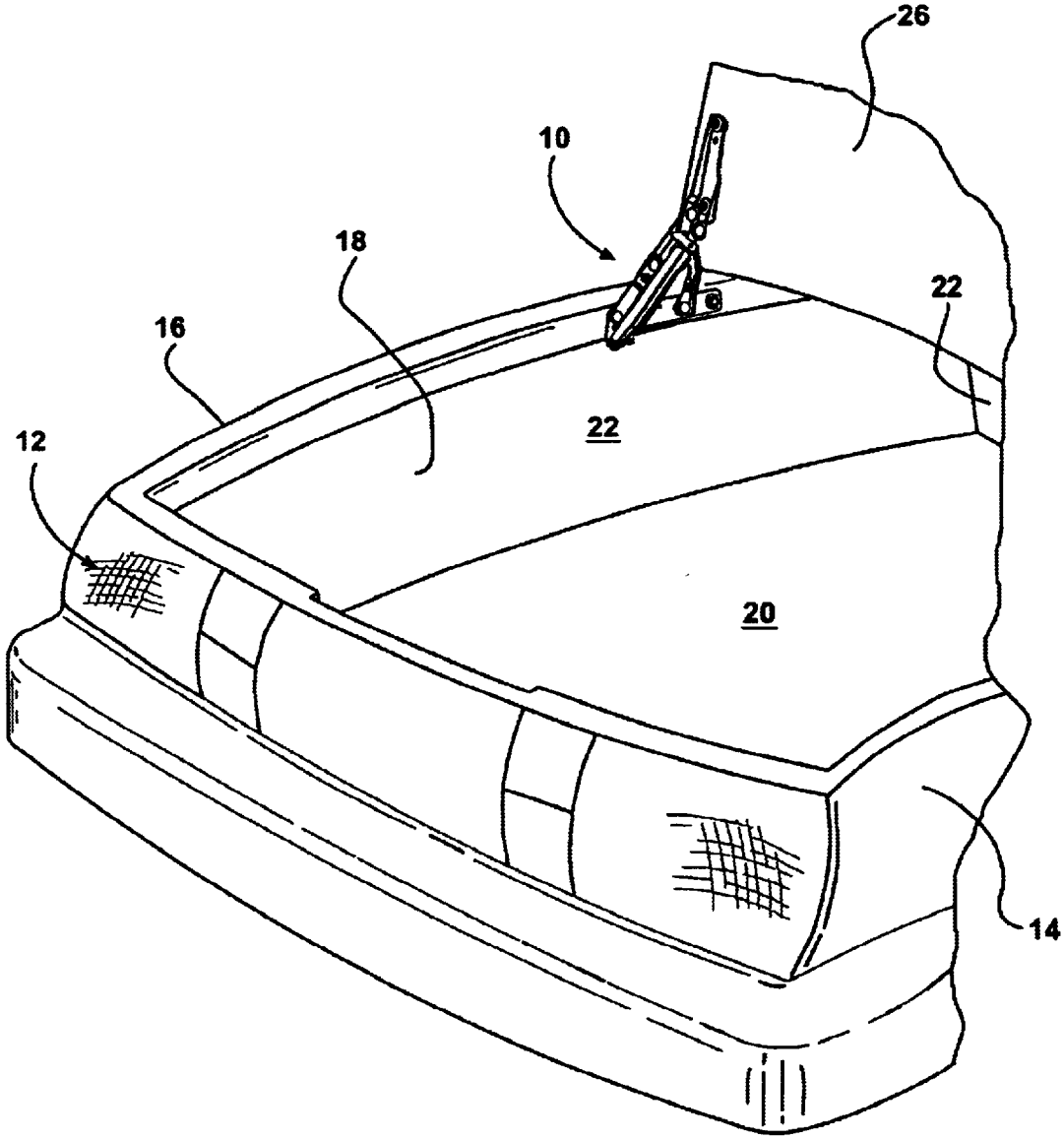
FIG. 1 is a perspective view of a decklid hinge, according to the present invention, illustrated in operational relationship with a vehicle.

Referring to the drawings and in particular FIG. 1, one embodiment of a decklid hinge 10, according to the present invention, is shown for a vehicle such as a motor vehicle, generally indicated at 12. Such motor vehicles 12 typically include a vehicle body 14 (partially shown) forming a rear compartment 16. The rear compartment 16 has a recess 18 therein. The recess 18 is formed by a floorpan 20 and side walls 22 extending upwardly from the floorpan 20 and generally perpendicular thereto. The vehicle body 14 also includes a decklid 26 closing the recess 20. The decklid 26 is attached to the rear compartment 16 of the vehicle body 14 by at least one, preferably a pair of laterally spaced decklid hinges 10, according to the present invention. It should be appreciated that only one decklid hinge 10 is illustrated in FIG. 1 and will be subsequently described. It should also be appreciated that, except for the decklid hinge 10, the vehicle 12 is conventional and known in the art.

Figure 2:
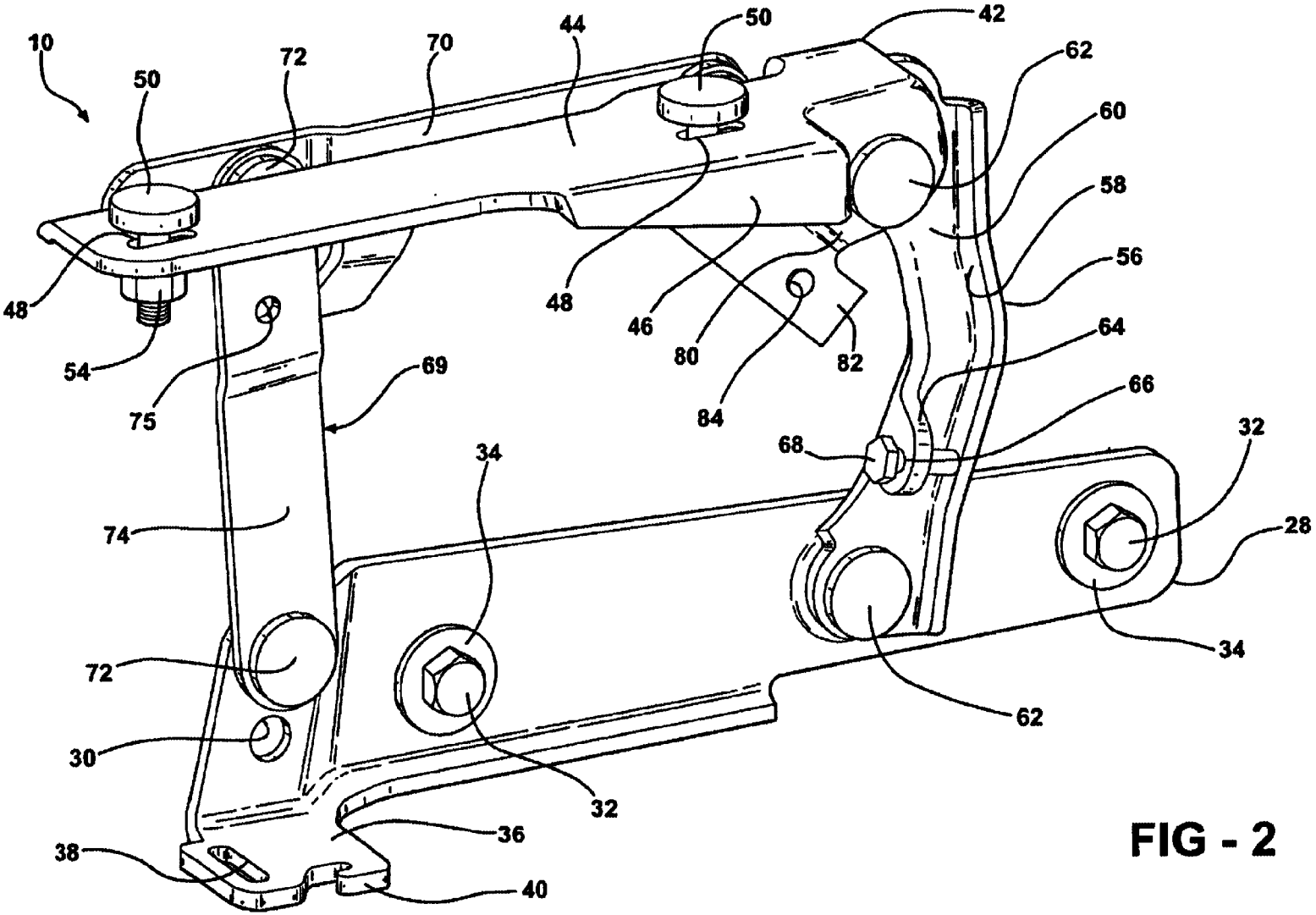
FIG. 2 is a perspective view of the decklid hinge of FIG. 1 illustrated in a service position.
Figure 3:
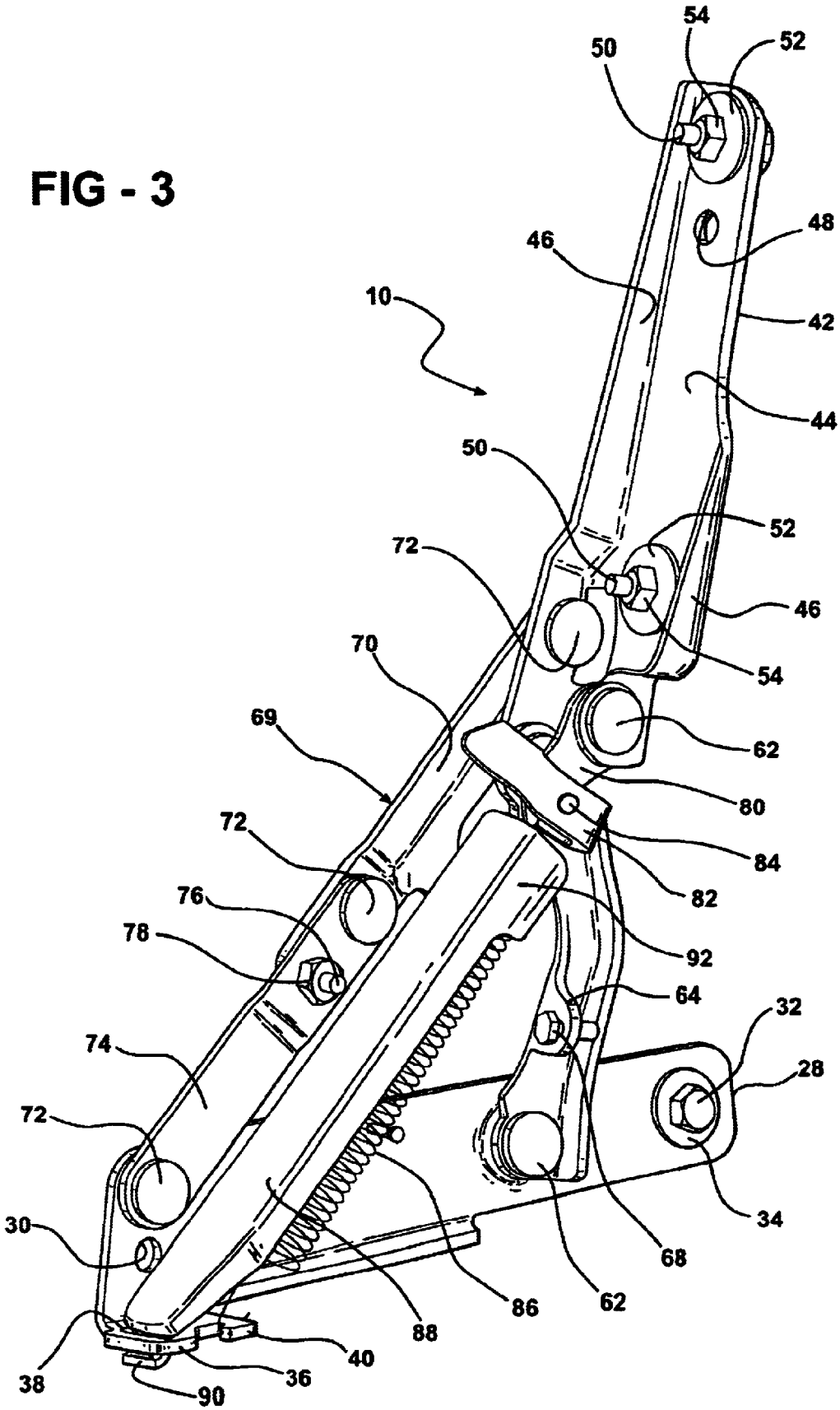
FIG. 3 is a perspective view of the decklid hinge of FIG. 1 illustrated in a normal operating position.

Referring to FIGS. 2 and 3, the decklid hinge 10 includes a body side strap 28 to allow the decklid hinge 10 to be mounted to the vehicle body 14. The body side strap 28 is generally rectangular in shape. The body side strap 28 extends longitudinally and has at least one, preferably a plurality of apertures 30 extending therethrough. The decklid hinge 10 also includes at least one, preferably a plurality of fasteners 32 such as bolts to attach the body side strap 28 to the vehicle body 14. Each of the fasteners 32 may include a washer 34 and extend through some of the apertures 30 and corresponding apertures (not shown) in the vehicle body 14 and are engaged by nuts (not shown) to prevent the fasteners 32 from disengaging the apertures 30. It should be appreciated that the fasteners 32 are conventional and known in the art.

The body side strap 28 also includes a flange 36 extending generally perpendicularly and outwardly at one end thereof. The flange 36 is generally rectangular in shape. The flange 36 may have an elongated aperture 38 extending therethrough for a function to be described. The flange 36 may include a spring retention hook 40 extending laterally and longitudinally therefrom. The body side strap 28 is made of a rigid material such as metal.

The decklid hinge 10 includes a decklid side strap 42 to allow the decklid 26 to be attached to the decklid hinge 10. The decklid side strap 42 is generally L shaped. The decklid side strap 42 extends longitudinally, relative to the decklid, and has a base wall 44 and a pair of side walls 46 spaced laterally and extending generally perpendicular to the base wall 44. The base wall 44 includes at least one, preferably a plurality of apertures 48 extending therethrough. The decklid hinge 10 also includes at least one, preferably a plurality of fasteners 50 such as bolts to attach the decklid side strap 42 to the decklid 26. Each of the fasteners 50 may include a washer 52 and extend through some of the apertures 48 and corresponding apertures (not shown) in the decklid 26 and are engaged by nuts 54 to prevent the fasteners 50 from disengaging the apertures 48. The decklid side strap 42 is made of a rigid material such as metal. It should be appreciated that the fasteners 50 are conventional and known in the art.

The decklid hinge 10 also includes a first or short link 56 to allow pivoting action of the decklid hinge 10. The first link 56 extends longitudinally and has a base wall 58 and a side wall 60 extending generally perpendicular to the base wall 58. The base wall 58 includes at least one, preferably a plurality of apertures (not shown) extending therethrough. The first link 56 is made of a rigid material such as metal.

The decklid hinge 10 includes at least one, preferably a plurality of fasteners 62 such as rivets or bolts to attach the first link 56 to the decklid side strap 42 at a forward end thereof and to the body side strap 28 at a forward end thereof. The first link 56 also includes a flange 64 extending generally perpendicularly and outwardly at one end thereof. The flange 64 may have an aperture 66 extending therethrough to receive a fastener 68 such as a bolt. It should be appreciated that the fasteners 62 and 68 are conventional and known in the art.

The decklid hinge 10 also includes a second or upper link, generally indicated at 69, to guide the pivoting action of the hinge 10 along a predetermined path. The upper link 69 includes an upper long link 70 extending longitudinally to allow pivoting action to a service position to be described. The upper long link 70 includes at least one, preferably a plurality of apertures (not shown) extending therethrough. The upper long link 70 is made of a rigid material such as metal.

The decklid hinge 10 includes at least one, preferably a plurality of fasteners 72 such as bolts to attach the upper long link 70 to the decklid side strap 42 at a forward end thereof. The upper link 69 also includes a lower long link 74 extending longitudinally to provide a secondary pivot location for the service position to be described. The fasteners 72 attach the lower long link 74 to a rearward end of the upper long link 70 and a rearward end of the body side strap 28. The upper link 69 further includes a fastener 76, FIG. 3, such as a lock bolt extending through apertures 75, FIG. 2, in the upper long link 70 and lower long link 74 to hold the links 70 and 72 together for normal operation. The upper link 69 also includes a nut 78 engaging the fastener 76 to prevent the fastener 76 from disengaging the apertures 75. The lower long link 70 is made of a rigid material such as metal. It should be appreciated that the fasteners 72 and 76 are conventional and known in the art.

The decklid hinge 10 includes a pop and hang link 80 to enable the decklid 26 to pop and hang at an approximately forty-five degrees (45°) open condition. The hang link 80 has an aperture (not shown) extending therethrough to receive the fastener 62. The hang link 80 also has a flange 82 extending outwardly and overlapping the hang link 80. The flange 82 has an aperture 84 extending therethrough for a function to be described. The hang link 80 is made of a rigid material such as metal.

The decklid hinge 10 further includes a counterbalance spring 86 to power the decklid 26 to a pop and hang position by applying a force to the pop and hang link 80. The counterbalance spring 86 is of a coil type and has a first end extending through the aperture 84 and connected to the hang link 80. The counterbalance spring 86 also has a second end connected to the spring retention hook 40. The counterbalance spring 86 is made of a spring material such as metal.

The decklid hinge 10 may include a spring cover 88 extending longitudinally and having a first end 90 extending through the aperture 38 and a second end, 92 disposed about the first end of the spring 86. The spring cover 88 is made of a rigid material such as plastic. It should be appreciated that the spring cover 88 moves with the spring 86.

Referring to FIG. 2, the decklid hinge 10 is shown in a service position. In this position, the spring 86, spring cover 88, and fastener 76 are not attached. This allows the upper long link 70 and lower long link 74 to pivot and be oriented at approximately ninety degrees (90°).

Referring to FIG. 3, the decklid hinge 10 is shown in a normal operating position. In this position, the spring 86, spring cover 88, and fastener 76 are attached to the decklid hinge 10. This allows the upper long link 70 and lower long link 74 to be held together and pivot as a single unit and for the spring 86 to urge the decklid 26 to a pop and hang position by applying a force to the pop and hang link 80. As a result, the counterbalance spring 86 counterbalances the weight of the decklid 26 in the open position. It should be appreciated that the decklid hinge 10 allows the decklid 26 to be rotated open and closed.

The decklid hinge 10 allows installation of the counterbalance spring 86 without the need for a spring pre-tensioner tool. The decklid hinge 10 also allows installation of backlite glass without the need for removing and reinstalling the decklid 26 in the vehicle assembly plant and vehicle dealerships for service. The decklid hinge 10 provides customer convenience without reducing volume of the recess 18 of the rear compartment 16 or complicating the hinge assembly process to the vehicle 12.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A decklid hinge for a decklid an a rear compartment of a vehicle comprising:

a body side strap adapted to be connected to a vehicle body of the vehicle;

a decklid side strap adapted to be connected to a decklid for closing access of the rear compartment;

a first link interconnecting said body side strap and said decklid strap for allowing rotation therebetween;

a second link interconnecting said body side strap and said decklid side strap for guiding pivoting action of the hinge along a predefined path, said second link comprising an upper link pivotally connected to said decklid side strap and a lower link pivotally connected to said upper link and pivotally connected to said body side strap; and a counterbalance coil spring interconnecting said body side strap and said decklid side strap to counterbalance a weight of the decklid in an open position.

2. A decklid hinge as set forth in claim 1 including a fastener for removably fastening said upper link and said lower link together to rotate as a unit.

3. A decklid hinge as set forth in claim 1 including a pop and hang link pivotally connected to said first link.

4. A decklid hinge as set forth in claim 3 wherein said counterbalance coil spring has one end connected to said pop and hang link and another end connected to said body side strap.

5. A decklid hinge as set forth in claim 1 including fasteners for fastening said body side strap to the vehicle body and said decklid side strap to the decklid.

6. A decklid hinge as set forth in claim 1 including fasteners for fastening said first link to a forward end of said body side strap and said decklid side strap.

7. A decklid hinge for a decklid on a rear compartment of a vehicle comprising:

a body side strap adapted to be connected to a vehicle body of the vehicle;

a decklid side strap adapted tube connected to a decklid for closing a recess of the rear compartment;

a first interconnecting said body side strap and said decklid side strap for allowing rotation therebetween;

a second link interconnecting said body side strap and said decklid side strap for guiding pivoting action of the hinge along a predefined path;

a counterbalance spring interconnecting said body side strap and said decklid side strap to counterbalance a weight of the decklid in an open position; and a spring cover having a first end connected to said body side strap and a second end disposed about and connected to said counterbalance spring.

8. A decklid hinge for a rear compartment of a vehicle comprising:

a body side strap adapted to be connected to a vehicle body of the vehicle;

a decklid side strap adapted to be connected to a decklid for closing a recess of the rear compartment;

a first link interconnecting said body side strap and said decklid side strap for allowing rotation therebetween;

a second link interconnecting said body side strap and said decklid side strap for guiding pivoting action of the hinge along a predefined path, said second link comprising an upper link pivotally connected to said decklid side strap and a lower link pivotally connected to said upper link and pivotally connected to said body side strap;

a pop and hang link pivotally connected to said first link; and a counterbalance spring interconnecting said pop and hang link and said body side strap to counterbalance a weight of the decklid in an open position.

9. A decklid hinge as set forth in claim 8 including a fastener for removably fastening said upper link and said lower link together to rotate as a unit.

10. A decklid hinge as set forth in claim 8 wherein said counterbalance spring has one end connected to said pop and hang link and another end connected to said body side strap.

11. A decklid hinge as set forth in claim 8 wherein said counterbalance spring is of a coil type.

12. A decklid hinge as set forth in claim 8 including fasteners for fastening said body side strap to the vehicle body and said decklid side strap to the decklid.

13. A decklid hinge as set forth in claim 8 including fasteners for fastening said first link to a forward end of said body side strap and said decklid side strap.

14. A decklid hinge for a rear compartment of a vehicle comprising:

a body side strap adapted to be connected to a vehicle body of the vehicle;

a decklid side strap adapted to be connected to a decklid for closing a recess of the rear compartment;

a first interconnecting said body side strap and said decklid side strap for allowing rotation therebetween;

a second link interconnecting said body side strap and said decklid side strap for guiding pivoting action of the hinge along a predefined path;

a pop and hang link pivotally connected to said first link;

a counterbalance spring interconnecting said pop and hang link and said body side strap to counterbalance a weight of the decklid in an open position; and a spring cover having a first end connected to said body side strap and a second end disposed about and connected to said counterbalance spring.

15. A rear compartment of a vehicle comprising:

a vehicle body having a recess formed therein;

a decklid for opening and closing said recess; and at least one decklid hinge interconnecting said vehicle body and said decklid, said at least one decklid hinge comprising a body side strap connected to said vehicle body, a decklid side strap connected to said decklid, a first link interconnecting said body side strap and said decklid strap for allowing rotation therebetween, a second link interconnecting said body side strap and said decklid side strap for guiding pivoting action of said hinge along a predefined path, said second link comprising an upper link pivotally connected to said decklid side strap and a lower link pivotally connected to said upper in and pivotally connected to said body side strap, and a counterbalance coil spring interconnecting said body side strap and said decklid side strap to counterbalance a weight of said decklid in an open position.

* * * * *